US006325197B1

(12) United States Patent
Furuya

(10) Patent No.: US 6,325,197 B1
(45) Date of Patent: Dec. 4, 2001

(54) METHOD AND DEVICE FOR CHECKING COIN FOR FORGERY

(75) Inventor: Yonezo Furuya, Saitama (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 0 days.

(21) Appl. No.: 09/403,824

(22) PCT Filed: Feb. 25, 1999

(86) PCT No.: PCT/JP99/00881

§ 371 Date: Oct. 26, 1999

§ 102(e) Date: Oct. 26, 1999

(87) PCT Pub. No.: WO99/44176

PCT Pub. Date: Sep. 2, 1999

(51) Int. Cl.[7] ..... G07D 5/08
(52) U.S. Cl. ..... 194/318
(58) Field of Search ..... 194/317, 318, 194/319, 328, 330

(56) References Cited

U.S. PATENT DOCUMENTS 3,373,856 * 3/1968 Kusters et al. ..... 194/318
3,870,137 3/1975 Fougere .
5,458,225 * 10/1995 Iwamoto et al. ..... 194/318

FOREIGN PATENT DOCUMENTS

S61-80491 A 4/1986 (JP) .
H5-89319 A 4/1993 (JP) .
H6-124380 A 5/1994 (JP) .
H8-44926 A 2/1996 (JP) .
H8-212416 A 8/1996 (JP) .

* cited by examiner

*Primary Examiner*—F. J. Bartuska
(74) *Attorney, Agent, or Firm*—Koda & Androlia

(57) ABSTRACT

A method of and apparatus for determining authenticity of coins based on difference in surface irregularity pattern of coins. A coin passage is inclined at a predetermined angle, and an exciting coil is arranged near one side wall of the coin passage such that the two magnetic poles of the exciting coil face the coin passage. Two receiving coils having substantially identical characteristics are arranged near the same passage wall such that they are electromagnetically coupled with te exciting coil. The exciting coil is excited at a predetermined frequency, and an influence of a demagnetizing or reactive magnetic field caused by eddy current induced on the surface of a coin is detected by the receiving coils. The level of the demagnet or reactive magnetic field varies depending on difference in surface irregularity pattern of coins, and thus authenticity of coins can be determined based on the difference in surface irregularity pattern. This can be attained with a simple, inexpensive arrangement. Even those coins which are almost identical in material, outside diameter and thickness can be discriminated from one another based on the difference in surface regularity pattern.

22 Claims, 7 Drawing Sheets

MPU
OSCILLATION CIRCUIT
AD CONVERTOR
SIGNAL INSPECTION CIRCUIT
MEMORY
CLOCK
$V_{CC}$
20
11
17
18
21
22
19
12
13
14
15
R1(Z3)
R2(Z4)
Z1
Z2
C1
C2
C3
C4
C5
C6
C7
C8
R3
R4
R5
R6
R7
R8
R9
R10
R11
R12
TR1
TR2
A1
D1
D2
L1
1
2a
2b
3

VERTICAL AXIS: 1(V)/div
HORIZONTAL AXIS: 20(ms)/div

COMPARISON OF DATA OF REPRESENTATIVE COINS

| | U.S. 5-CENT COIN | PANAMA 5-CENTESIMO COIN |
|---|---|---|
| MATERIAL | SINGLE CUPRONICKEL | SINGLE CUPRONICKEL |
| DIAMETER | ϕ 21.2mm | ϕ 21.2mm |
| THICKNESS | 1.9mm | 1.8mm |

METHOD AND DEVICE FOR CHECKING COIN FOR FORGERY

DESCRIPTION

1. Technical Field

The present invention relates to a method of and apparatus for determining authenticity of coins by discriminating them, and more particularly to a method of and apparatus for determining authenticity of coins used in automatic vending machines, game machines, etc.

2. Background Art

Coin discrimination apparatus prevailing in recent years is an electronic type using induction coils. This type of coin discrimination apparatus generally utilizes the falling of coins due to their own weight and is provided with a passage for guiding a coin inserted from a coin slot. A plurality of sets of induction coils are arranged along the passage to produce electromagnetic fields excited by respective different frequencies.

Inspection of coins is performed by detecting an amount of electrical change (change in frequency, voltage or phase) derived due to the interaction between the electromagnetic field and a coin when the coin passes through the electromagnetic field, to thereby inspect the authenticity of the coin.

Since in many cases features of coins appear in relation to frequency-dependent parameters, conventional coin inspection apparatus employs techniques of inspecting materials, outside diameters, thicknesses, etc. of coins by means of a plurality of frequencies, as disclosed in U.S. Pat. No. 3,870,137.

In recent so-called borderless societies in which coins can be easily brought from one country to another, an increasing number of such unacceptable coins tend to be used erroneously or deceitfully. Some of the coins used in various countries resemble each other in material, outside diameter, thickness, etc., and a typical example is 5-cent coin used in the U.S.A. and 5-centesimo coin used in Panama. Such coins differ from each other only in surface design (surface irregularity pattern) and are substantially identical with each other in material, outside diameter and thickness. With the conventional arrangement using induction coils, however, the surface irregularity patterns of coins show too subtle a change to be detected by simply using a plurality of frequencies, with the result that resembling coins like those mentioned above cannot be discriminated from each other.

Also, a 500-yen coin used in Japan and a 500-won coin used in South Korea are almost identical with each other in material and outside diameter, and differ from each other in that a 500-won coin has a slightly greater thickness. Thus, if a 500-won coin is machined and is used as a 500-yen coin, it is difficult to discriminate the two from each other with the conventional method in which the thickness, outside diameter and material of coins are inspected to determine the authenticity thereof.

Attempts have also conventionally been made to adopt an optical process such as image processing as a means of discriminating resembling coins like those mentioned above. However, optical apparatus has a problem that the authenticity determination of coins can be adversely affected by adhesion of dust or the like, and is also large in size and expensive because of its complicated structure.

DISCLOSURE OF INVENTION

The object of the present invention is to provide a method and apparatus for determining authenticity of coins whereby coins can be discriminated from each other with high accuracy.

A coin authenticity determining method of the present invention comprises the steps of: arranging an exciting coil and a receiving coil in the vity of a coin passage so that the exciting coil and the receiving coil are electromagnetically connected with each other, exciting the exciting coil to produce an electromagnetic field with such a frequency Iat an influence of a demagnetizing or reactive magnetic field caused by eddy current induced on a surface of the coin when the coin passes the electromagnetic field is detected by the receiving coil, and detecting the electomagnetic field influenced by the demagnetizing or reactive magnetic field as an electromotive force signal by the receiving coil; and discriminating the coin based on the electromotive force signal detected by the receiving coil.

The surface of the coin passing through the coin passage and the receiving coil should preferably be close to each other, and therefore the coin passage is formed such that the coin is inclined to one side of the coin passage where the exciting coil and the receiving coil are arranged. Also, the degree of penetration of electromagnetic field into a coin varies depending on the material of the coin and excitation frequency. Thus, an excitation frequency with which a difference in surface irregularity pattern of coins appears well as a difference of the signal from the receiving coil varies depending on the material of coins to be discriminated. Accordingly, the frequency at which the exciting coil is to be excited is selected in accordance with material of coins to be discriminated.

Specifically, authenticity of coins is determined by using an exciting coil arranged in the vicinity of one side of a coin passage inclining at a predetermined angle so that magnetic poles of the exciting coil faces the coin passage, two receiving coils having substantially identical characteristics and arranged in the vicinity of the coin passage so that the receiving coils are electromagnetically connected with the exciting coil, exciting means for exciting the exciting coil at a predetermined frequency to produce an electromagnetic field, bridge circuit means including the receiving coils, differential amplifier means connected to the bridge circuit means, detector means connected to the differential amplifier means, and determining means connected to the detector means, for comparing a signal obtained when a coin passes the electromagnetic field with a feature of a predetermined denomination stored in advance and determining that the coin is authentic if the signal is within a predetermined allowable range with respect to the feature.

BEST MODE OF CARRYING OUT THE INVENTION

Figure 1A:
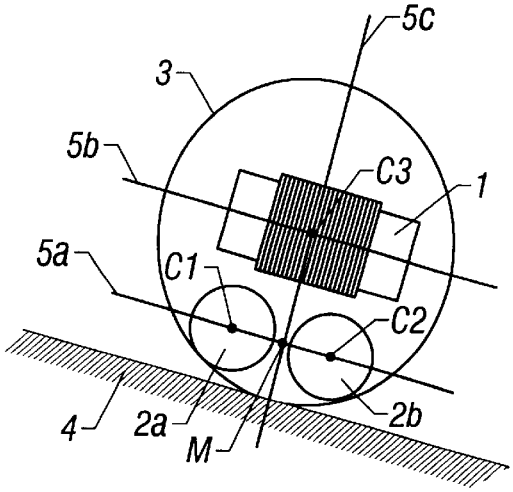
FIGS. 1*a* and 1*b* are a front view and a sectional view, respectively, showing a detection coil arrangement for detecting a surface irregularity pattern of a coin according to a first embodiment of the present invention.
Figure 1B:
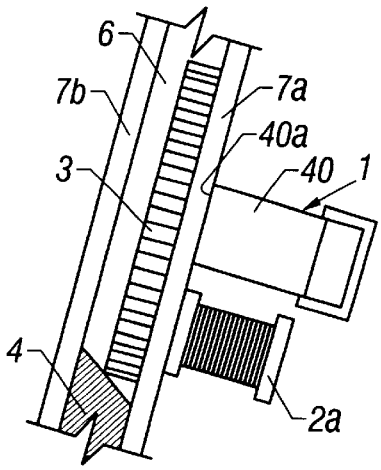
Figure 2:
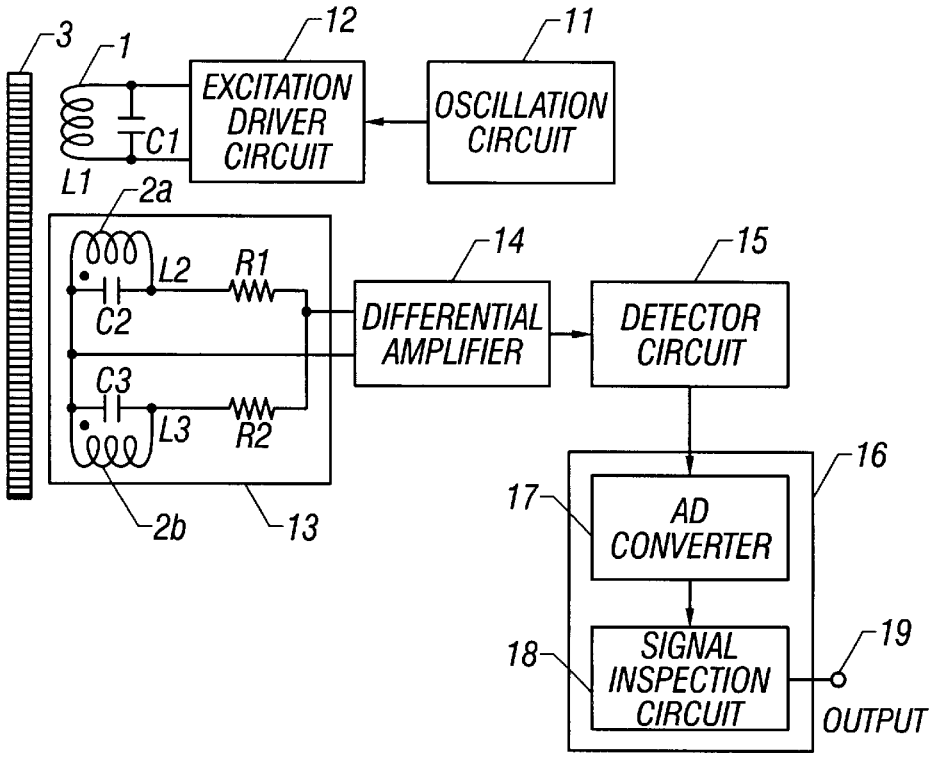
FIG. 2 is a block diagram showing a circuit arrangement according to the embodiment of the present invention.

Referring first to FIGS. 1*a*, 1*b* and 2, one embodiment of the present invention will be described.

As shown in FIGS. 1*a* and 1*b*, a detector for discriminating a coin 3 comprises one exciting coil 1 and two receiving coils 2*a* and 2*b*, and is arranged in contact with one side wall 7*a* of a coin passage 6. The coin passage 6 is sloped at a predetermined angle to allow the coin 3 to roll down while being guided thereby and comprises a coin rail 4 arranged at the bottom thereof and a pair of passage walls 7*a* and 7*b*. The passage walls 7*a* and 7*b* are, as shown in FIG. 1*b*, inclined with respect to the vertical direction so that the coin 3 may roll down while being inclined toward the passage wall 7*a*. Also, the surface of the coin rail 4, on which the coin is guided, is inclined in the direction in which the passage walls 7*a* and 7*b* are inclined so that the coin 3 passing thereon may be inclined toward the passage wall 7*a*.

Figure 5A:
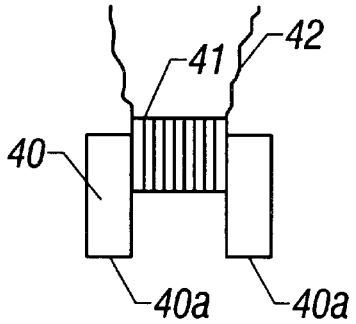
FIGS. 5*a* and 5*b* are a front view and a sectional view, respectively, showing details of the coil arrangement according to the embodiment of the present invention.
Figure 5B:
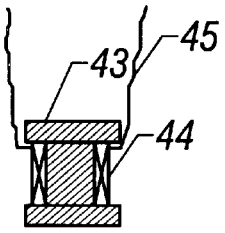

Each of the two receiving coils 2*a* and 2*b* comprises, as shown in FIG. 5*b*, a drum type core 43 and a coil 44 wound around the core 43. As shown in FIG. 1*a*, the receiving coils 2*a* and 2*b* are arranged above the coin rail 4 at a predetermined distance from each other such that a line 5*a* connecting the centers of the coils 2*a* and 2*b* is substantially parallel with the coin rail 4.

The exciting coil 1 comprises, as shown in FIG. 5*a*, a ⊐-shaped core 40 made of a magnetic material and a coil 41 wound around the core 40. As shown in FIG. 1*a*, the exciting coil 1 is arranged above the receiving coils 2*a* and 2*b* such that the center C3 of the core 40 thereof is located on a line 5*c* which is perpendicular to the line 5*a* connecting the centers C1 and C2 of the receiving coils 2*a* and 2*b* and which passes through the middle point M of the line segment C1C2 and also that a line 5*b* connecting the centers of two pole faces 40*a* thereof is substantially parallel with the coin rail 4. Further, as shown in FIG. 1*b*, the core 40 is arranged such that the pole faces 40*a* thereof are parallel with the face of the coin 3 passing thereby. In FIGS. 5*a* and 5*b*, reference numerals 42 and 45 each denote a lead wire.

The exciting coil 1 and the receiving coils 2*a* and 2*b* arranged as described above are electromagnetically coupled by means of an electromagnetic field produced by excitation of the exciting coil 1.

In FIG. 2, an oscillation circuit 11 outputs to an output terminal thereof a rectangular wave signal of predetermined frequency generated by an MPU (microprocessor unit) or the like, for example. The output of the oscillation circuit 11 is connected to an excitation driver circuit 12, the output of which is in turn connected to the exciting coil 1 to excite same. Consequently, in accordance with the output signal of the excitation driver circuit 12, the exciting coil 1 produces an electromagnetic field in the vicinity thereof.

In the two receiving coils 2*a* and 2*b*, on the other hand, an electromotive force corresponding to the strength of the electromagnetic field produced by the exciting coil 1 is generated. The exciting coil 1 and the receiving coils 2*a* and 2*b* are preferably arranged for inspection so as to be close to the face of the coin 3, as mentioned above.

When the coin 3 is acted upon by the electromagnetic field, eddy current is induced in the vicinity of the surface of the coin 3 excited by the exciting coil 1, and with increase in excitation frequency, the eddy current produces an intenser demagnetizing field in the vicinity of the outer periphery of the coin due to skin effect. Demagnetizing current induced in the vicinity of the surface region at the outer periphery of the coin due to this phenomenon interacts with the receiving coils 2*a* and 2*b*, accompanying a change corresponding to a subtle contour feature of the coin surface. Thus, in each of the receiving coils 2*a* and 2*b* is produced an electromotive force corresponding to such change of the demagnetizing current caused by change of the contour feature of the coin 3. A signal generated by the electromotive force is hereinafter referred to as the "detection signal."

Further, since the magnetic poles of the exciting coil 1 are arranged in the vicinity of the receiving coils 2*a* and 2*b*, a change of the demagnetizing current induced when the coin 3 is acted upon by the electromagnetic field produced by these magnetic poles can be acquired at a location near the magnetic poles.

The demagnetizing current induced due to the skin effect is noticeably observed near the outer periphery of the coin, but in cases where coins have large surface irregularity, the region of coins where a change of the demagnetizing current can be detected is not particularly limited to the outer peripheral region alone. Based on the detection signal of the receiving coils 2*a* and 2*b*, a corresponding alternating voltage signal is generated in a bridge circuit 13 including the receiving coils 2*a* and 2*b*, and is output to a differential amplifier 14. The differential amplifier 14 amplifies the alternating voltage signal generated by the bridge circuit 13 and outputs the thus-amplified signal to a detector circuit 15. The detector circuit 15, which is supplied with the alternating voltage signal amplified by the differential amplifier 14, generates a direct voltage signal corresponding to the detection signal and outputs same to a determination circuit 16. The direct voltage signal is supplied to an AD converter 17 in the determination circuit 16, in which the signal is converted to a digital signal of corresponding voltage, which signal is then output to a signal inspection circuit 18 in the determination circuit 16. The signal inspection circuit 18 determines whether or not the coin 3 has a given feature, and outputs the result of determination to an output terminal 19. The output of the signal inspection circuit 18 is used to drive a deflector solenoid, described later, or a coin counter or the like, not shown.

Figure 3:
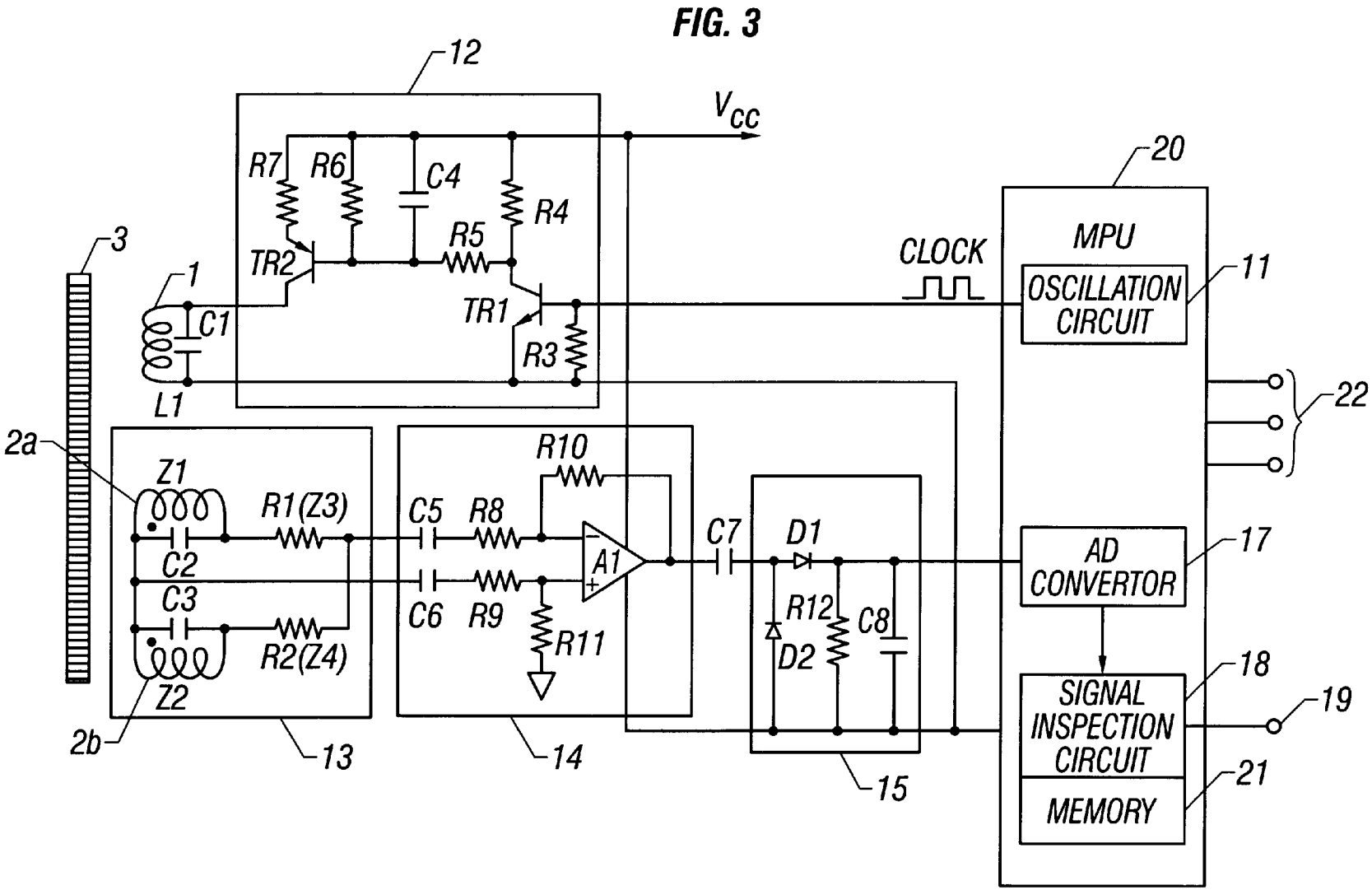
FIG. 3 is a diagram showing details of circuits according to the embodiment.
Figure 4:
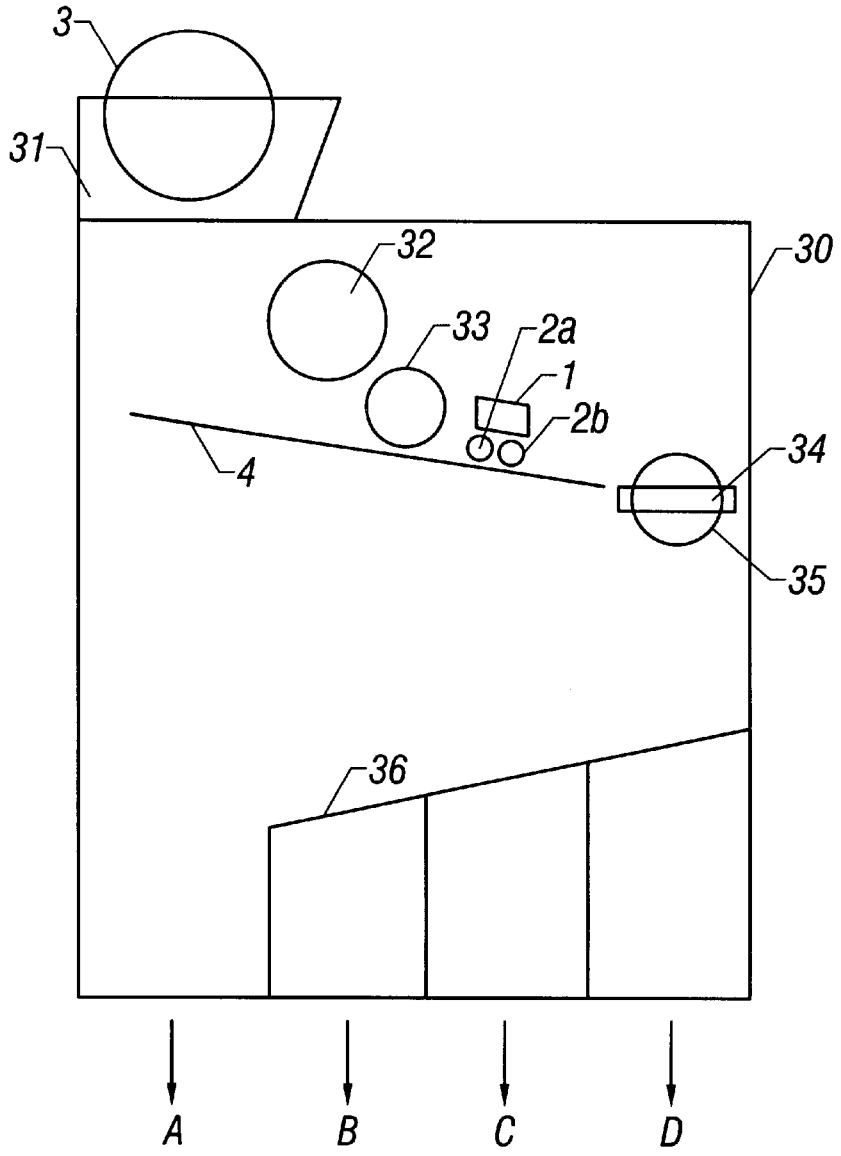
FIG. 4 is a front view of an apparatus for inspecting authenticity of coins according to an embodiment of the present invention.

FIG. 3 shows details of the circuits appearing in the block diagram of FIG. 2. FIG. 4 is a front view of a coin inspection apparatus using the detection coil for detecting surface irregularity patterns, and FIGS. 5*a* and 5*b* are a front view and a sectional view, respectively, showing details of the coil arrangement.

Referring to FIG. 3, the arrangement of the individual circuits shown in the block diagram of FIG. 2 will be described in detail. The oscillation circuit 11 is constructed with the use of frequency divider means or the like which is connected to an MPU 20 for dividing a reference clock signal generated therein. The exciting coil 1 is connected in parallel with a capacitor C1 to form an LC parallel resonance circuit so that resonance thereof may occur in the vicinity of the predetermined frequency output from the oscillation circuit 11.

The excitation driver circuit 12 comprises a transistor TR1 and resistors R3 and R4 connected to one another to perform switching operation; an integrating circuit made up of a resistor R5, a capacitor C4 and a resistor R6 for converting the rectangular wave output from the oscillation circuit 11 into a waveform approximate to a triangular wave; and a driver circuit including a transistor TR2 connected to the exciting coil 1 constituting the LC parallel resonance circuit, and a resistor R7.

The bridge circuit 13 comprises a capacitor C2 connected in parallel with the receiving coil 2*a*, a capacitor C3 connected in parallel with the receiving coil 2*b*, and resistors R1 and R2.

The differential amplifier 14 comprises capacitors C5 and C6 connected to the output of the bridge circuit 13 in an AC coupling fashion, an operational amplifier A1, and resistors R8, R10 and R9, R11 connected so as to determine the gain of the operational amplifier.

The detector circuit 15 comprises a rectifier circuit (voltage multiplying rectifier circuit) including diodes D1 and D2 connected to a coupling capacitor C7 connected to the output of the differential amplifier 14, and an integrating circuit including a resistor R12 and a capacitor C8.

The AD converter 17 and the signal inspection circuit 18 of the determination circuit 16 are constituted by using the MPU 20 (microprocessor unit).

The oscillation circuit 11 outputs a rectangular wave signal with a predetermined frequency, and to detect a difference of the sure irregularity pattern of the coin 3 with high sensitivity, the frequency of the signal is preferably selected such that the electmagnetic field penetrates into the such region of the irregularity pattern of the coin, but not up to the central region thereof, and that the influence of the demagnetizing or reactive magnetic field caused by eddy current is noticeable. The frequency to be employed varies depending on the material of coins to be discriminated, and in the case of discrimination between 5-cent coin of the U.S.A, and 5-centesimo coin of Panama, both made of cupronickel, the excitation frequency of the exciting coil 1 is preferably 70 kHz to 90 kHz. An experiment according to this invention, described later, was conducted with the frequency set at 90 kHz.

The frequency at which the exciting coil 1 is to be excited is selected in accordance with the material of coins to be detected. Specifically, using coins having an identical outside diameter but different thicknesses, the voltage detected by the receiving coils 2*a* and 2*b* is measured with the excitation frequency successively varied, and that frequency with which a large change of the detected voltage is caused by the difference in thickness of coins is selected as the excitation frequency.

In the case of cupronickel, for example, it was confirmed by experiment that, with the excitation frequency set at about 70 kHz to 90 kHz, the detected voltage showed the largest change in response to the difference in thickness. With frequencies higher than or lower than a frequency band of 70 kHz to 90 kHz, change of the detected voltage in response to the difference in thickness of coins gradually lessens as the frequency becomes remoter from the frequency band. To discriminate coins by difference in thickness, that is, by difference in surface irregularity pattern of coins, the above excitation frequency of 70 kHz to 90 kHz is preferred for cupronickel coins.

Where the material of coins to be discriminated is brass, for example, an excitation frequency of about 7 kHz to 10 kHz causes the output voltage to greatly vary in response to the difference in thickness of coins. Accordingly, in the case of discriminating coins made of brass by their surface irregularity pattern, the discrimination can be efficiently carried out by using the excitation frequency of 7 kHz to 10 kHz.

In the excitation driver circuit 12, the rectangular wave signal output from the oscillation circuit 11 is integrated to be converted into a waveform approximate to a triangular wave by the integrating circuit composed of the resistor R5, the capacitor C4 and the resistor R6, so that the exciting coil 1 is excited by the approximated triangular wave signal. The LC resonance circuit constituted by the exciting coil 1 and the capacitor C1 resonates with the aforementioned frequency, and as a result, the exciting coil 1 is driven at both ends by a sinusoidal wave.

The bridge circuit 13 with the above-described arrangement constitutes an AC bridge circuit, and this AC bridge circuit is balanced when the condition $$Z1 \cdot Z4 = Z2 \cdot Z3$$

is fulfilled, where Z1 is the impedance caused by the receiving coil 2*a* and the capacitor C2 connected in parallel with each other, Z2 is the impedance caused by the receiving coil 2*b* and the capacitor C3 connected in parallel with each other, Z3 is the impedance of the resistor R1, and Z4 is the impedance of the resistor R2.

The output of the bridge circuit 13 is a signal appearing between the junction point between the receiving coils 2*a* and 2*b* and the junction point between the resistors R1 and R2, as shown in FIG. 3; therefore, provided the voltage across the receiving coil 2*a* is V1, the current flowing to the impedance Z1 is i1, the voltage across the receiving coil 2*b* is V2, and the current flowing to the impedance Z2 is i2, a voltage Vdef of the signal appearing between the above two junction points is given as follows (it is assumed that the impedance Z3 of the resistor R1 is equal to the impedance Z4 of the resistor R2):

$$V1 = Z1 \cdot i1$$

$$V2 = Z2 \cdot i2$$

$$Vdef = V1 - V2$$

$$Vdef = Z1 \cdot i1 - Z2 \cdot i2$$

In this embodiment, the resonance frequency of the LC resonance circuit constituted by the receiving coil 2*a* and the capacitor C2 and the resonance frequency of the LC resonance circuit constituted by the receiving coil 2*b* and the capacitor C3 are set so as to be substantially equal to the oscillation frequency output from the oscillation circuit 11. Accordingly, the impedances Z1 and Z2 are substantially equal to each other, and the signal appearing between the aforementioned two junction points is a voltage signal induced by the difference between the currents i1 and i2.

The differential amplifier 14 amplifies the alternating voltage signal input thereto from the bridge circuit 13 to obtain a desired alternating voltage signal, which is then output to the detector circuit 15.

The detector circuit 15, which is supplied with the alternating voltage signal output from the differential amplifier 14, performs detection and rectification of the signal by means of the diode D1, and then converts the signal to a direct voltage signal corresponding to the output of the bridge circuit 13 by means of the integrating circuit constituted by the resistor R12 and the capacitor C8.

The AD converter 17 is implemented by an AD converter of successive approximation and conversion type built in the MPU 20 and having a resolution of, for example, 8 bits. The AD converter 17 samples the analog direct voltage signal from the detector circuit 15 at predetermined intervals of time and converts same to a digital signal corresponding to the output of the bridge circuit 13, the resulting digital signal train being output to the signal inspection circuit 18.

The signal inspection circuit 18, which is thus supplied with the digital signal train on an amplitude axis from the AD converter 17, temporarily stores the signal train in a memory such as RAM, obtains a statistic based on the digital signal train temporarily stored in the RAM and data train of a corresponding denomination stored beforehand in the memory 21, then compares the obtained statistic with a predetermined value stored in advance in the memory 21 to determine whether or not the coin in question has a given feature, and outputs the result of inspection to the output terminal 19.

As a specific method of obtaining the above statistic, the following equation may be used to derive a correlation coefficient:

$$r = \frac{\sum_{i=1}^{N} (Xi - Xa)(Yi - Ya)}{\sqrt{\sum_{i=1}^{N} (Xi - Xa)^2}\sqrt{\sum_{i=1}^{N} (Yi - Ya)62}} \quad (1)$$

In equation (1) above, N represents the number of samples, variable Xi is a sampling value, that is, a value of the aforementioned digital signal train obtained through measurement of a coin to be detected, and variable Yi is a statistical value obtained through sampling/measurement of coins of acceptable denomination with the use of an apparatus according to this invention. Xa and Ya are average values of the respective variables.

Taking the processing speed of the MPU into consideration, the deviation (Yi−Ya) between the sampling value Yi of acceptable denomination and its average value Ya in the sum of deviation cross products in the numerator of equation (1) and the square root of the sum of squares of the deviation between the sampling value Yi and its average value Ya in the denominator of equation (1) may be calculated in advance and stored in the memory 21, in which case the speed of execution of the subsequent process can be greatly increased.

The absolute value of the correlation coefficient r obtained by equation (1) falls within a range of $0 \leqq |r| \leqq 1$, as is conventionally known, and therefore, whether a coin to be detected has a given feature or not can be determined by comparing the correlation coefficient r with a predetermined value stored beforehand. If the coefficient r is infinitely close to "1", then the coin in question can be judged to be a genuine coin of acceptable denomination. On the other hand, if, as a result of the inspection, the coefficient is found to be infinitely close to zero, the coin in question can be judged false. Thus, the above predetermined value for authenticity judgment is set to a value smaller than and close to "1" for coins to be discriminated, and when a correlation coefficient r greater than the set value is derived, the coin in question is judged to be a genuine coin.

Figures 6, 7:
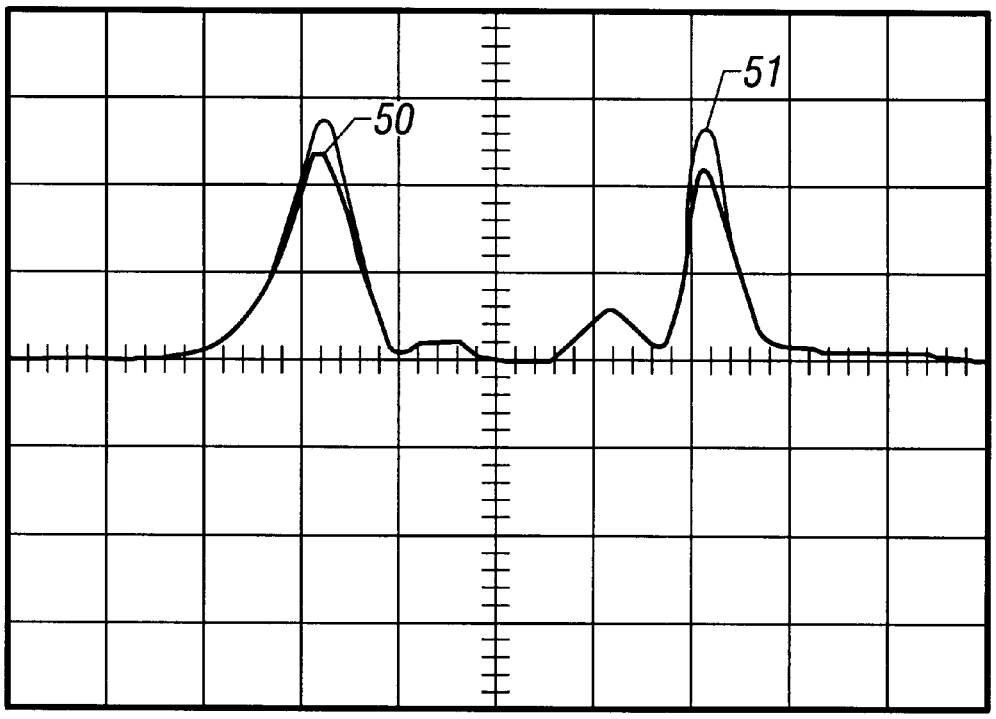
FIG. 6 is a characteristic diagram showing the characteristics of representative coins according to the embodiment of the present invention.
FIG. 7 is a diagram showing comparison of data of the representative coins according to the embodiment of the present invention.

Referring now to FIGS. 6 and 7, characteristics of representative coins measured using the apparatus of this invention will be described. FIG. 6 shows the characteristics of the representative coins and FIG. 7 shows comparison of data of the coins. As shown in FIG. 7, 5-cent coin of the U.S.A. and 5-centesimo coin of Panama, as representative coins, are very alike in material (cupronickel), diameter, and thickness. The two coins, when observed visually, are different from each other only in their surface design.

FIG. 6 is a characteristic diagram showing the results of measurement of these coins by means of the apparatus of this invention wherein the exciting coil 1 was excited at an excitation frequency of 90 kHz. In FIG. 6, reference numeral 50 (thick line) represents the characteristic curve of 5-cent coin of the U.S.A., and 51 represents the characteristic curve of 5-centesimo coin of Panama. As shown in FIG. 6, difference in characteristics between these two coins appears in the first and last peaks. This peak difference arose presumably because a demagnetizing field characterized by the irregularity of surface pattern of the coin was produced by eddy current induced on the coin surface and was detected as a subtle difference in electromotive force generated in the aforementioned two receiving coils. The above difference could not be detected by conventional techniques.

Referring now to FIGS. 4 and 2, the operation of an apparatus 30 for inspecting authenticity of coins will be described in detail.

In the authenticity inspection apparatus 30 for coins shown in FIG. 4, a coin 3 inserted from a coin slot 31 falls naturally due to its own weight onto the coin rail 4 arranged under the coin slot 31. The coin 3 thus dropped on the coin rail 4 rolls down through the coin passage 6 (FIG. 1*b*) in a downstream direction away from the coin slot 31. While moving through the coin passage 6, the coin 3 passes by an outside diameter detection coil 32, a material detection coil 33, and a surface irregularity pattern detection coil including the exciting coil 1 and the receiving coils 2*a* and 2*b*. The apparatus 30 inspects the authenticity of the coin 3 while the coin 3 passes the individual detection coils. If, as a result of the inspection, the coin 3 is judged to be genuine, a deflector solenoid 35 is driven in accordance with the signal output to the output terminal 19, to actuate a gate 34 such that the coin 3 is guided to a genuine-coin passage, not shown. On the other hand, if as a result of the inspection the coin 3 is judged to be a false coin, the gate 34 is not actuated, so that the coin 3 is guided to a false-coin passage, not shown, to be let out from an outlet, not shown.

When the coin 3 is genuine and thus introduced to the genuine-coin passage, it continues to fall naturally and drops onto a coin rail 36. The coin 3 which has dropped onto the coin rail 36 is then sorted by conventionally known sorting means, not shown, according to denomination, and let out from a corresponding one of outlets A, B, C and D provided for respective denominations.

For the outside diameter detection coil 32 and the material detection coil 33 mentioned above, conventional inspection techniques may be used.

Figure 8:
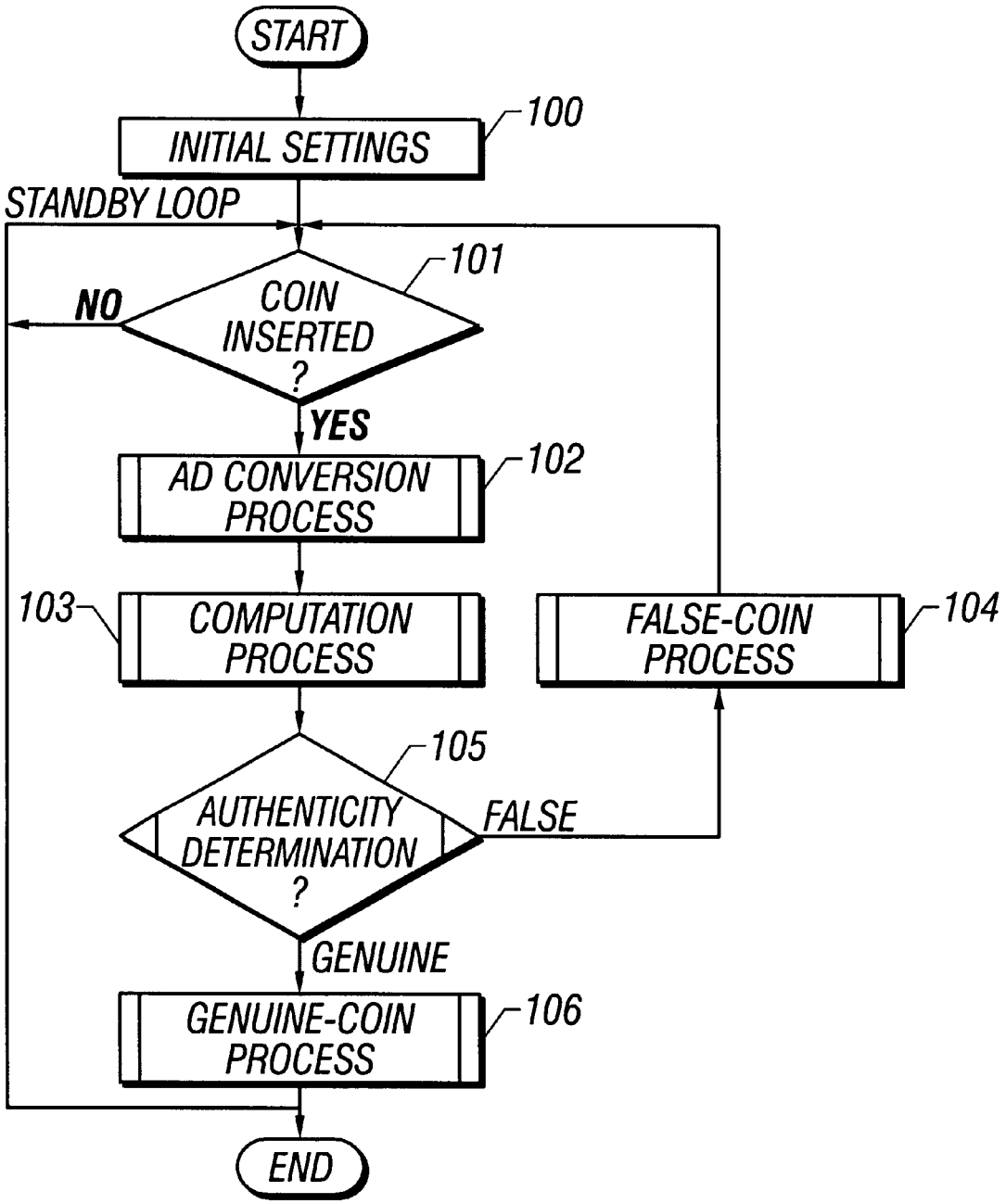
FIG. 8 is a flowchart showing an operation according to the embodiment of the present invention.

Referring now to the flowchart of FIG. 8, the operation of the apparatus 30 for inspecting the authenticity of coins by means of the detection coil for detecting surface irregularity pattern will be described in detail. In FIG. 8, when the power supply to the apparatus is switched on, initial settings such as input/output settings in the MPU 20 are carried out in Step 100. After execution of Step 100, a process for determining whether or not a coin has been inserted in the apparatus is executed in Step 101 by using the signal from the detection coil. If it is judged in Step 101 that a coin has been inserted, the program proceeds to an AD conversion process in Step 102. On the other hand, if it is judged in Step 101 that a coin has not been inserted yet, a standby process is repeated until arrival of a coin.

When it is judged in Step 101 that a coin has been inserted, the AD conversion process is executed in Step 102, as mentioned above. On reception of the signal indicative of arrival of a coin at the detection coil, the AD conversion process of Step 102 starts to sample the output signal of the detector circuit 15, which is the signal from the receiving coils 2*a* and 2*b* of the detection coil for detecting surface irregularity pattern. The result of sampling is temporarily stored in memory such as RAM in the MPU 20 and the program proceeds to a computation process in Step 103.

In the computation process of Step 103, a correlation coefficient r is obtained using the value of the digital signal train temporarily stored in the memory and the statistic of acceptable coin stored beforehand in the memory 21, in accordance with the aforementioned equation (1), and the program proceeds to an authenticity judgment process in Step 105.

In the authenticity judgment process of Step 105, the correlation coefficient obtained in the computation process of Step 103 is compared with the predetermined value of acceptable coin stored in advance, and if the relationship, correlation coefficient r>predetermined value, is fulfilled, the coin in question is judged to be genuine, and the program proceeds to a genuine-coin process in Step 106. If, on the other hand, it is judged that the relationship, correlation coefficient r<predetermined value, is fulfilled, the coin in question is judged to be false; in which case the program executes a false-coin process in Step 104 and returns to the standby loop.

When the coin in question is judged to be genuine in the authenticity judgment process of Step 105, the genuine-coin process is executed in Step 106, as mentioned above. In the genuine-coin process of Step 106, a process of outputting a genuine-coin signal, a denomination signal, etc. is executed in accordance with the result of authenticity judgment, whereupon the program returns to the standby loop.

Figure 9A:
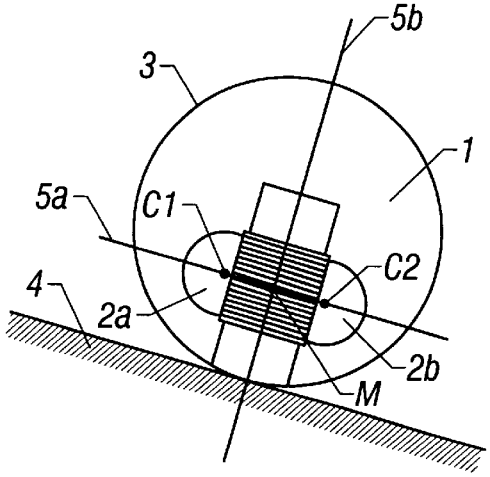
FIGS. 9*a* and 9*b* are a front view and a sectional view, respectively, showing a detection coil arrangement for detecting a surface irregularity pattern according to a second embodiment of the present invention.
Figure 9B:
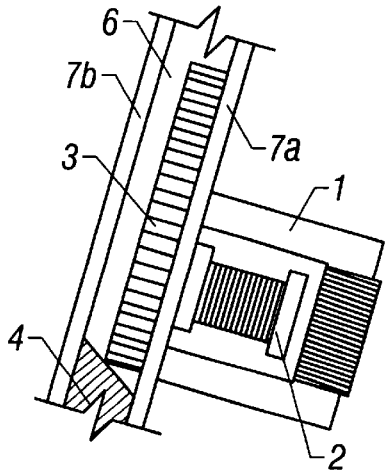

FIGS. 9*a* and 9*b* show the arrangement of a detector for detecting surface irregularity pattern according to a second embodiment of the present invention. The second embodiment differs from the first embodiment described above only in that the exciting coil 1 and the receiving coils 2*a* and 2*b* are arranged such that the line 5*b* connecting the centers of the pole faces 40*a* at the longitudinally opposite end portions of the ⊐-shaped core 40 of the exciting coil 1 is perpendicular to the line 5*a* connecting the centers of the receiving coils 2*a* and 2*b* and passes through the middle point M between the centers C1 and C2 of the receiving coils 2*a* and 2*b*. The operation and effects of the second embodiment are identical with those of the first embodiment, and therefore, description thereof is omitted.

Figure 10A:
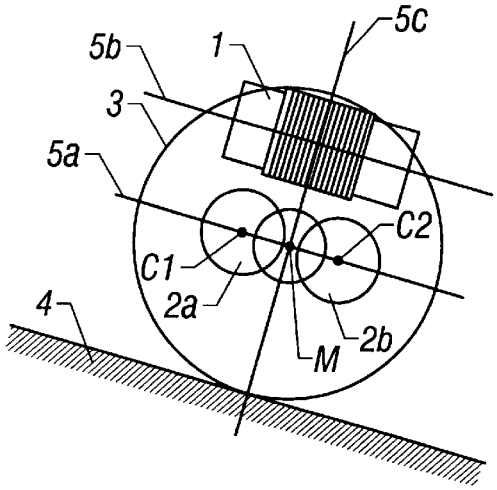
FIGS. 10*a* and 10*b* are a front view and a sectional view, respectively, showing another detection coil arrangement for detecting a surface irregularity pattern according to a third embodiment of the present invention.
Figure 10B:
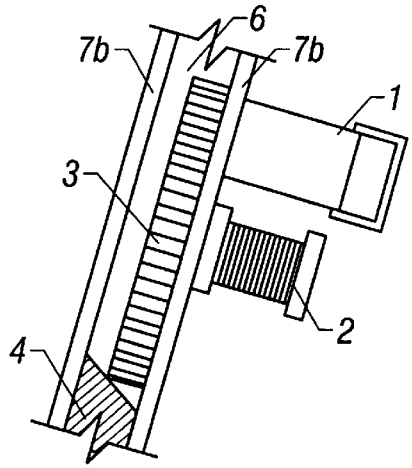

FIGS. 10*a* and 10*b* show the arrangement of another detector for detecting surface irregularity pattern according to a third embodiment of the present invention. The third embodiment differs from the above-described first embodiment only in that the line 5*a* connecting the centers of the receiving coils 2*a* and 2*b* is shifted in the vertical direction with respect to the coin rail 4 on which the coin 3 rolls down, so as to pass the central portion of the coin 3 to be detected. In the third embodiment, the receiving coils 2*a* and 2*b* are arranged at a location corresponding to the central portion of the coin 3 to be detected, and accordingly, the detection value varies in accordance with difference in surface irregularity pattern of the central portion of the coin 3, so that the arrangement is suited for judging authenticity of coins by determining whether or not the coin has a hole in the center thereof.

Figure 11A:
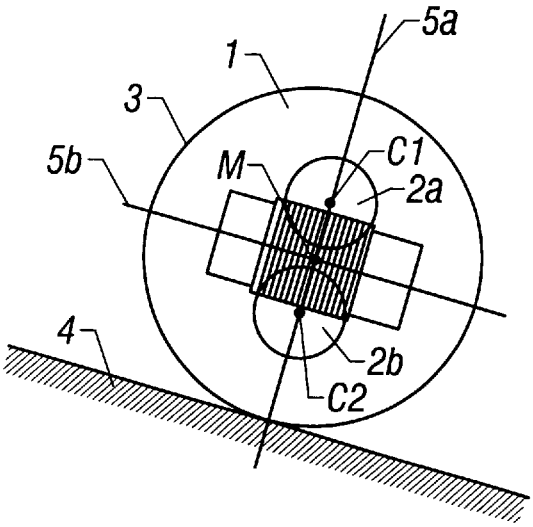
FIGS. 11*a* and 11*b* are a front view and a sectional view, respectively, showing still another detection coil arrangement for detecting a surface irregularity pattern according to a fourth embodiment of the present invention.
Figure 11B:
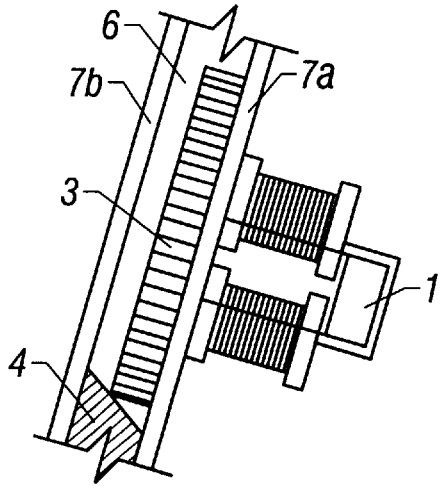

FIGS. 11*a* and 11*b* show the arrangement of still another detector for detecting surface irregularity pattern according to a fourth embodiment of the present invention. The fourth embodiment differs from the above-described first embodiment in that the side-by-side arrangement of the receiving coils is rotated by 90 degrees so that the line 5*a* connecting the centers of the receiving coils 2*a* and 2*b* may be perpendicular to the line 5*b* connecting the centers of the pole faces of the core of the exciting coil 1 and pass through the center of the exciting coil 1. Also in the fourth embodiment, the receiving coils 2*a* and 2*b* are arranged at a location corresponding to the central portion of the coin to be detected, and therefore, the arrangement of the fourth embodiment is suited for judging authenticity of coins by discriminating between presence and absence of change in the surface irregularity pattern of the central portion thereof.

As described above, the position where the receiving coils 2*a* and 2*b* are arranged (the position where the exciting coil is arranged in relation to the position of the receiving coils) may be changed in accordance with difference in surface irregularity pattern of coins whose authenticity is to be determined (depending on whether the difference in surface irregularity pattern exists in the central portion, e.g. presence/absence of a hole, or in the peripheral portion of the coin).

Also, according to the present invention, the exciting coil 1 is excited at a frequency such that the electromagnetic field produced penetrates only into the surface region of the coin but not up to the central region of same, and the influence of a demagnetizing field caused by eddy current induced in the vicinity of the surface of the coin is measured. Accordingly, the surfaces of the receiving coils 2*a* and 2*b* facing the coin should desirably be as close to the coin surface as possible.

Figure 12:
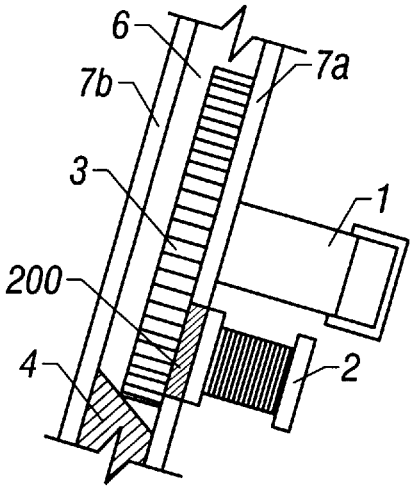
FIG. 12 is a view illustrating an example of structure in which a portion of a coin passage wall where receiving coils are arranged in the individual embodiments of the present invention is made of a material with high magnetic permeability.

As shown in FIG. 12, therefore, a portion of the passage wall 7*a* where the receiving coils 2*a* and 2*b* are arranged, that is, a portion of the passage wall 7*a* extending along the line 5*a* connecting the centers of the receiving coils 2*a* and 2*b* as shown in FIG. 1*a*, may be made of a material 200 having high magnetic permeability, so that the receiving coils 2*a* and 2*b* may be virtually located closer to the surface of the coin.

In the individual embodiments described above, the exciting coil 1 having a ⊐-shaped core is used, but cores of any other suitable shape such as a U-shaped core may be used without departing from the spirit and scope of this invention.

According to the present invention, since the surface irregularity patterns of coins can be detected, it is possible to provide at low cost a small-sized, high-performance coin inspection apparatus capable of dealing with a diversity of coins.

What is claimed is:

1. A method of discriminating a coin and determining authenticity thereof, comprising the steps of:

(a) arranging an exciting coil in the vicinity of one side of a coin passage inclining at a predetermined angle so that magnetic poles of said exciting coil faces the coin passage;

(b) arranging two receiving coils having substantially identical characteristics in the vicinity of said one side of the coin passage so that said receiving coils are electromagnetically connected with said exciting coil and electrically connected to a differential amplifier so that the differential amplifier receives the differential input from the two receiving coils;

(c) exciting said exciting coil at a predetermined frequency to produce an electromagnetic field such that said two receiving coils detect an influence of a reactive magnetic field caused by eddy current induced on a surface of the coin when the coin passes the electromagnetic field, and issue of electromotive force bias representing the influences of said reactive magnetic field as the differential input to said differential amplifier; and (d) discriminating the coin based on an output of said differential amplifier when the coin passes the electromagnetic field.

2. A method of discriminating a coin and determining authenticity thereof according to claim 1, wherein said step (c) includes a step of setting said frequency in accordance with material of the coin to be discriminated.

3. A method of discriminating a coin and determining authenticity thereof according to claim 1, wherein said step (d) includes the steps of:

sampling the electromotive force signal detected by said receiving coil in every predetermined period; and detecting a feature of the coin through a statistical process based on the sample values.

4. A method of discriminating a coin and determining authenticity thereof according to claim 3, wherein said statistical process includes the steps of: obtaining a coefficient of correlation with respect to a reference coin; and discriminating the coin based on magnitude of said coefficient of correlation.

5. A method of discriminating a coin and determining authenticity thereof according to claim 1, wherein said step (a) includes a step of arranging said exciting coil at a predetermined distance from said receiving coils so that a line connecting centers of magnetic poles of said exciting coil is substantially parallel with an extending direction of the coin passage, and said step (b) includes a step of arranging said two receiving coils above a coin rail provided with said coin passage so that a line connecting centers of said two receiving coils is substantially parallel with an extending direction of said coin passage.

6. A method of discriminating a coin and determining authenticity thereof according to claim 1, wherein said step (a) includes a step of arranging said exciting coil at a predetermined distance from said receiving coils so that a line connecting centers of magnetic poles of said exciting coil is substantially perpendicular to an extending direction of the coin passage, and said step (b) includes a step of arranging said two receiving coils above a coin rail provided with said coin passage so that a line connecting centers of said two receiving coils is substantially parallel with an extending direction of said coin passage.

7. A method of discriminating a coin and determining authenticity thereof according to claim 1, wherein said step (a) includes a step of arranging said exciting coil at a predetermined distance from said receiving coils so that a line connecting centers of magnetic poles of said exciting coil is substantially parallel with an extending direction of the coin passage, and said step (b) includes a step of arranging said two receiving coils above a coin rail provided with said coin passage so that a line connecting centers of said two receiving coils is substantially perpendicular to an extending direction of said coin passage.

8. A method of discriminating a coin and determining authenticity thereof according to claim 1, wherein said coin passage is formed so that a coin passing therethrough is inclined to said one side of said coin passage where said exciting coil and said receiving coils are arranged.

9. A method of discriminating a coin and determining authenticity thereof according to claim 1, wherein said step (d) includes the steps of comparing signals obtained when the coin passes said electromagnetic field with a feature of a predetermined denomination stored in advance; and determining that the coin is authentic if the signals are within a predetermined allowable range with respect to the feature.

10. A method of discriminating a coin and determining authenticity thereof according to claim 1, wherein said exciting coil comprises a U-shaped magnetic member having the magnetic poles flush with each other and a coil wound around said magnetic member.

11. A method of discriminating a coin and determining authenticity thereof, comprising the steps of:

(a) arranging an exciting coil in the vicinity of one side of a coin passage inclining at a predetermined angle so that magnetic poles of said exciting coil faces the coin passage;

(b) arranging two receiving coils having substantially identical characteristics in the vicinity of said one side of the coin passage so that said receiving coils are electromagnetically connected with said exciting coil;

(c) exciting said exciting coil at a predetermined frequency to produce an electomagnetic field; and (d) discriminating the coin based on signals detected by said two receiving coils when the coin passes the electromagnetic field; and wherein: said step (d) includes the steps of discriminating the coin using bridge circuit means including said receiving coils, differential amplifier means connected to said bridge circuit means, detector means connected to said differential amplifier means and inspection means connected to said detector means.

12. An apparatus for discriminating a coin and determining authenticity thereof, comprising:

an exciting coil arranged in the vicinity of one side of a coin passage inclining at a predetermined angle so that magnetic poles of said exciting coil faces the coin passage;

two receiving coils having substantially identical characteristics and arranged in the vicinity of said one side of the coin passage so that said receiving coils are electromagnetically connected with said exciting coil and electrically connected to a differential amplifier so that the differential amplifier receives the differential input from said two receiving coils;

exciting means fox exciting said exciting coil at a predetermined frequency to produce an electromagnetic field such that said two receiving coils detect an influence of a reactive magnetic field caused by eddy current induced on a surface of the coin when the coin passes the electromagnetic field, and issues electromotive force signals representing the influences of said reactive magnetic field as the differential input to said differential amplifier; and discriminating means for discriminating the coin based on an output of said differential amplifier when the coin passes the electromagnetic field.

13. An apparatus for discriminating a coin and determining authenticity thereof according to claim 12, wherein said frequency is set in accordance with material of the coin to be discriminated.

14. An apparatus for disaiminatng a coin and determining authenticity thereof according to claim 12, wherein said discriminating means samples the electromotive force signal detected by said receiving coil in every predetermined period, and detecting a feature of the coin trough a statistical process based on the sampled values.

15. An apparatus for discriminating a coin and determining authenticity thereof according to claim 14, wherein said statistical process is performed by obtaining a coefficient of correlation with respect to a reference coin, and discriminating the coin based on magnitude of said coefficient of correlation.

16. An apparatus for discriminating a coin and determining authenticity thereof according to claim 12, wherein said exciting coil is arranged at a predetermined distance from said receiving coils so that a line connecting centers of magnetic poles of said exciting coil is substantially parallel with an extending direction of said coin passage, and said two receiving coils are arranged above a coin rail provided with said coin passage so that a line connecting centers of said two receiving coils is substantially parallel with an extending direction of said coin passage.

17. An apparatus for discriminating a coin and determining authenticity thereof according to claim 12, wherein said exciting coil is arranged at a predetermined distance from said receiving coils so that a line connecting centers of magnetic poles of said exciting coil is substantially perpendicular to an extending direction of said coin passage, and said two receiving coils are arranged above a coin rail provided with said coin passage so that a line connecting centers of said two receiving coils is substantially parallel with an extending direction of said coin passage.

18. An apparatus for discriminating a coin and determining authenticity thereof according to claim 12, wherein said exciting coil is arranged at a predetermined distance from said receiving coils so that a line connecting centers of magnetic poles of said exciting coil is substantially parallel with an extending direction of said coin passage, and said two receiving coils are arranged above a coin rail provided with said coin passage so that a line connecting centers of said two receiving coils is substantially perpendicular to an extending direction of said coin passage.

19. An apparatus for discriminating a coin and determining authenticity thereof according to claim 12, wherein said coin passage is formed so that a coin passing therethrough is inclined to said one side of said coin passage where said exciting coil and said receiving coils are arranged.

20. An apparatus for discriminating a coin and determining authenticity thereof according to claim 12, wherein said discriminating means compares a signal obtained when the coin passes said electromagnetic field with a feature of a predetermined denomination stored in advance, and determines that the coin is authentic if the signal is within a predetermined allowable range with respect to the feature.

21. An apparatus for discriminating a coin and determining authenticity thereof according to claim 12, wherein said exciting coil comprises a U-shaped magnetic member having the magnetic poles flush with each other and a coil wound around said magnetic member.

22. An apparatus for discriminating a coin and determining authenticity thereof comprising:

an exciting coil arranged in the vicinity of one side of a coin passage inclining at a predetermined angle so that magnetic poles of said exciting coil faces the coin passage;

two receiving coils having substantially identical characteristics and arranged in the vicinity of said one side of the coin passage so that said receiving coils are electromagnetically connected with said exciting coil;

exciting means for exciting said exciting coil at a predetermined frequency to produce an electromagnetic field; and discriminating means for discriminating the coin based on signals detected by said two receiving coils when the coin passes the electromagnetic field; and wherein said discriminating means discriminates the coin using bridge circuit means including said receiving coils, differential amplifier means connected to said bridge circuit means, detector means connected to said differential amplifier means and inspection means connected to said detector means.

* * * * *

UNITED STATES PATENT AND TRADEMARK OFFICE

CERTIFICATE OF CORRECTION

PATENT NO. : 6,325,197 B1
DATED : December 4, 2001
INVENTOR(S) : Yonezo Furuya

It is certified that error appears in the above-identified patent and that said Letters Patent is hereby corrected as shown below:

Column 11,
Line 10, paragraph (c), change "bias" to -- signals --.

Signed and Sealed this

Second Day of July, 2002

*Attest:*

*Attesting Officer*

JAMES E. ROGAN
*Director of the United States Patent and Trademark Office*